US006942457B2

(12) United States Patent
Pennington et al.

(10) Patent No.: US 6,942,457 B2
(45) Date of Patent: Sep. 13, 2005

(54) FAN ASSEMBLY AND METHOD

(75) Inventors: Donald R. Pennington, Kingston, IL (US); Richard G. Hext, III, Belvidere, IL (US)

(73) Assignee: Revcor, Inc., Carpentersville, IL (US)

( * ) Notice: Subject to any disclaimer, the term of this patent is extended or adjusted under 35 U.S.C. 154(b) by 63 days.

(21) Appl. No.: 10/306,105

(22) Filed: Nov. 27, 2002

(65) Prior Publication Data

US 2004/0101407 A1 May 27, 2004

(51) Int. Cl.[7] ..... F01D 5/30

(52) U.S. Cl. ..... 416/144; 416/210 R; 416/243; 416/DIG. 3

(58) Field of Search ..... 416/144, 145, 416/500, 210 R, DIG. 3, 223 R, 243, DIG. 2

(56) References Cited

U.S. PATENT DOCUMENTS

| | | | |
|---|---|---|---|
| 2,258,459 | A | 10/1941 | Marbach |
| 2,853,140 | A | 9/1958 | Forth, Sr. |
| 2,900,202 | A | 8/1959 | Thompson |
| 2,912,159 | A | 11/1959 | Granger et al. |
| 2,952,102 | A | 9/1960 | Morrison et al. |
| 3,223,313 | A | 12/1965 | Kinsworthy |
| 3,251,540 | A | 5/1966 | Kinsworthy |
| 3,285,502 | A | 11/1966 | Wooden |
| 3,407,882 | A | 10/1968 | Wooden et al. |
| 3,498,529 | A | 3/1970 | Wooden |
| 3,628,888 | A | 12/1971 | Wooden |
| 3,708,243 | A | 1/1973 | Wooden |
| 3,709,633 | A | 1/1973 | Wooden |
| 3,773,435 | A | 11/1973 | Wooden |
| 3,891,349 | A | 6/1975 | Woollenweber, Jr. |
| 3,937,595 | A | 2/1976 | English et al. |
| 3,963,373 | A | 6/1976 | Macauley |

(Continued)

FOREIGN PATENT DOCUMENTS

| | | |
|---|---|---|
| CA | 935413 | 1/1973 |
| CA | 923474 | 3/1973 |
| CA | 973135 | 8/1975 |
| CA | 1050508 | 3/1979 |
| CA | 1067871 | 12/1979 |
| CA | 1071164 | 2/1980 |
| DE | 3707437 | 3/1988 |
| EP | 0259182 | 3/1988 |
| EP | 0408221 | 1/1991 |
| EP | 0761980 | 3/1997 |
| EP | 0857528 | 8/1998 |
| GB | 1572767 | 8/1980 |
| GB | 1577244 | 10/1980 |
| JP | 53-96512 | 8/1978 |

OTHER PUBLICATIONS

Advanced Technologies, Low Noise Fan, Extra Fan newly Developed, A & R News, pp. 86–87, Jan./Feb. 1986.

Smart Housewares Highlights, Appliance Manufacturer, pp. 44–45, Mar. 2000.

*Primary Examiner*—Edward K. Look
*Assistant Examiner*—Dwayne J. White
(74) *Attorney, Agent, or Firm*—Michael Best & Friedrich LLP

(57) ABSTRACT

Fans according to some embodiments of the present invention include a spider, a central hub coupled to the spider, and two or more fan blades. One or more fan design features can be employed (alone or in combination) in the fans of the present invention, including the use of spider arms and/or fan blades having twisted shapes, spider lobes having cupped shapes, spiders and/or fan blades having thinner dimensions than conventional spider and fan blades in similarly-sized fans, fan blades having narrower widths, larger camber-to-chord ratios and/or tapering camber-to-chord ratios, and embossments located on the spider or the fan blades of the fan. In addition, pre-balanced spider assemblies can be employed as an alternative to balancing a fan after assembly.

45 Claims, 4 Drawing Sheets

U.S. PATENT DOCUMENTS 4,008,007 A 2/1977 Shipes
4,025,231 A * 5/1977 Kochevar et al. ..... 416/144
4,028,007 A 6/1977 Cavagnero et al.
4,060,338 A 11/1977 Macauley
4,063,852 A 12/1977 O'Connor
D246,856 S 1/1978 O'Connor
4,142,844 A 3/1979 Brattstrom
4,147,471 A * 4/1979 Charles ..... 416/132 A
4,172,691 A 10/1979 Comstock et al.
4,174,924 A 11/1979 Smithson, Jr.
4,189,281 A 2/1980 Katagiri et al.
4,211,514 A 7/1980 Hawes
4,245,960 A 1/1981 Matthews
4,255,080 A 3/1981 Wilson et al.
D262,734 S 1/1982 Wooden
D262,735 S 1/1982 Wooden
D262,736 S 1/1982 Wooden
4,345,877 A 8/1982 Monroe
4,350,100 A 9/1982 Stephenson
4,358,245 A 11/1982 Gray
4,406,581 A 9/1983 Robb et al.
4,474,534 A 10/1984 Thode
4,511,308 A 4/1985 Russell et al.
4,548,548 A 10/1985 Gray
4,566,852 A 1/1986 Hauser
4,569,631 A 2/1986 Gray
4,569,632 A 2/1986 Gray
4,630,999 A 12/1986 De La Harpe
4,634,341 A 1/1987 Monroe
4,720,244 A 1/1988 Kluppel et al.
4,840,541 A 6/1989 Sakane et al.
4,900,228 A 2/1990 Yapp
4,917,572 A 4/1990 Van Houten
4,946,348 A 8/1990 Yapp
4,971,520 A 11/1990 Van Houten
4,995,787 A 2/1991 O'Connor
5,000,660 A 3/1991 Van Houten et al.
5,064,345 A 11/1991 Kimball
5,151,011 A 9/1992 Rezek
5,154,579 A 10/1992 Rezek
5,156,524 A 10/1992 Forni
5,156,786 A 10/1992 Monroe
5,213,476 A 5/1993 Monroe
5,221,187 A 6/1993 Lorea et al.
5,297,931 A 3/1994 Yapp et al.
5,326,225 A 7/1994 Gallivan et al.
5,328,330 A 7/1994 Monroe
5,342,167 A 8/1994 Rosseau
5,352,089 A 10/1994 Tokunaga et al.
5,423,660 A 6/1995 Sortor
5,489,186 A 2/1996 Yapp et al.
5,511,939 A 4/1996 Tokunaga et al.
5,520,515 A 5/1996 Bailey et al.
5,577,888 A 11/1996 Capdevila et al.
5,616,004 A 4/1997 Alizadeh
5,655,882 A 8/1997 Morgan et al.
5,707,205 A 1/1998 Otsuka
5,769,607 A 6/1998 Neely et al.
5,979,541 A 11/1999 Saito
6,059,532 A 5/2000 Chen et al.
6,241,474 B1 6/2001 Alizadeh et al.
6,287,078 B1 9/2001 Min et al.
6,325,597 B1 12/2001 Kim et al.
6,447,251 B1 * 9/2002 Zeng ..... 416/210 R

* cited by examiner 30
32
34
36
38a
38b
38c
38d
38e
4A
4B
4C
4D
4G
θ

FAN ASSEMBLY AND METHOD

FIELD OF THE INVENTION

This invention relates generally to air moving devices, and more particularly to fans, fan blades, and methods of making fans and fan blades.

BACKGROUND OF THE INVENTION

The fundamental design of fans and fan blades has been largely unchanged for many years. Many conventional fans consist of fan blades and a central structure to which the fan blades are connected (often referred to as a "spider"). Historically, both the spider and the associated fan blades have been overbuilt, resulting in heavy and often inefficient fan and fan blade designs. Due at least in part to market and industry conditions, improving such designs has not been necessary. However, with increasing competition and shrinking profit margins, a manufacturer of fans must address the problems associated with weight and inefficiency in order to remain competitive in the industry.

One significant challenge in fan design is a high manufacturing cost per unit. Inefficient use of material and multiple manufacturing steps contribute greatly to this challenge. For example, in order to provide sufficient strength and rigidity, conventional metal fans having a 16–24 inch diameter typically have a steel spider having a thickness ranging between 0.059 inches and 0.075 inches, and have steel or aluminum fan blades with a minimum thickness of 0.025 inches and 0.032 inches, respectively. The width of blades for such fans is greater than 8.0 inches and is often as wide as 9.5 inches. Combined with a heavy center steel hub, such features result in an overweight fan assembly. To drive down the manufacturing cost per unit and to remain competitive in the industry, new fan designs must be employed to address these fan limitations without any decrease in product performance.

Another example of a costly design problem in the fan industry is the balancing procedure necessary for many fans after assembly. Commonly, counterweights are added to the fan in order to correct an imbalance due to blade weight variation or other assembly weight variation. In some cases, two or more balancing tests must be run to determine whether the fan assembly has been adequately balanced. The balancing procedure for fans consumes valuable manufacturing time, is often very labor and material intensive, and increases the manufacturing cost of the fan.

In light of the problems and limitations of the prior art described above, a need exists for a fan that has a reduced amount of material so to minimize material costs, has the same or improved fluid moving capabilities as conventional fans, requires less balancing steps following fan assembly or that requires no after-assembly balancing, and that reduces one or more manufacturing costs of the fan. Each embodiment of the present invention achieves one or more of these results.

SUMMARY OF THE INVENTION

Some embodiments of the fan according to the present invention have three main components: a spider, a central hub at least partially defining a central axis of rotation of the fan, and two or more fan blades. In some cases, the spider has one or more of the following features: a central portion, two or more spider arms, and two or more spider lobes. The central portion of the spider can be connected to or can otherwise be adjacent to the central hub. Any number of spider arms radially extend from the central hub in any desired angular spacing. The spider arms can each terminate in a spider lobe which provides a mounting location for a fan blade.

A number of improvements according to the present invention are related to fans having a diameter ranging between about 16 inches and 24 inches. With regard to such fans, in some embodiments the spider is steel and is approximately 0.048 inches thick, compared to conventional spiders having thicknesses of between 0.059 inches and 0.075 inches. One or more design features of the present invention can be selected to enable the use of thinner material for the spider in fans having any size. For example, a high structural stiffness can be achieved by embossing the spider and/or by providing portions of the spider (e.g., the spider lobes) with a cupped shape rather than a flat shape. Such design features can increase the moment of inertia of the spider to result in an increase in spider stiffness. This increase in stiffness can help the spider resist bending and torsional loads applied to it.

Other design features that can be employed according to the present invention include the use of embossments between adjacent spider arms of the spider and a twisted spider arm shape providing a pitch for the fan blades. As mentioned above, the spider lobes can also be cupped. For example, this cupped shape can be at or adjacent to the fan blade mounting locations, and in some embodiments (e.g., in some fan blades having a 16–24 inch diameter), can be defined by a 3.5–4 inch radius of curvature. This stands in contrast to conventional cupped spider lobes in similarly sized fans, which have a much flatter shape defined by a radius of curvature that is 10 inches or larger.

With continued reference to 16–24 inch fans by way of example only, the fan blades in some embodiments are aluminum and have a thickness of about 0.020 inches—much thinner than the 0.032 inch aluminum blades and the 0.025 inch steel blades commonly employed in existing fan blades of similar length and width. One or more design features of the present invention can be selected to enable the use of thinner blades in fans having any size. For example, a higher blade stiffness can be achieved by embossing the fan blades and/or by providing the fan blades with larger cross-sectional camber-to-chord ratios (the measure of blade depth at a radial location along the blade) than conventional curved blades. A larger camber to chord ratio indicates a 'deeper' blade form when compared to a smaller ratio. In some embodiments of the present invention, the fan blades have a camber-to-chord ratio of approximately 0.12 at the root of the blade, compared to conventional blade root camber-to-chord ratios that are typically no greater than 0.075 at the blade root. Improved blade performance can also be achieved by providing the fan blades with a camber-to-chord ratio that tapers from a maximum value at the blade root to a minimum value at the blade tip. In some embodiments, the camber-to-chord ratio tapers from about 0.15 at the blade root to about 0.064 at the blade tip, in contrast to conventional designs having a camber-to-chord ratio tapering from about 0.075 at the blade root to about 0.06 at the blade tip.

Fan blades according to some embodiments of the present invention employ a twisted blade construction. Specifically, each blade has a 'twist' along the length of the blade. In some embodiments, the fan blade has an 8–11 degree twist along its length, as opposed to conventional fan blade twists that range between 6 and 7 degrees.

Although the fan blades according to the present invention can be the same width as conventional fan blades, various design features of the present invention (described above) enable the blade width to be decreased without significant sacrifice of blade efficiency or performance. For example, and with reference again to fans having a 16–24 inch diameter, the fan blades can have a width as small as 6 inches (and in some cases, even somewhat smaller, such as a 5.88 inch width). This is in contrast to conventional fan blade widths of 8–9.5 inches for similarly sized fans. Used with or without a spider having a reduced thickness as described above, this decrease in fan blade width can result in significant material savings and fan weight reduction.

Another aspect of the present invention relates to the process of fan balancing. In some embodiments, the spider can be produced having a shape that offsets the imbalance generated by one or more fasteners used to mount the spider to a drive shaft. This imbalance can often be the largest source of imbalance in the fan, especially in cases where the lighter spider and blade designs (described above) are employed. In some cases, the spider can be shaped with sufficient offset to eliminate the need for counterweights or balancing procedures after fan assembly.

Further objects and advantages of the present invention, together with the organization and manner of operation thereof, will become apparent from the following detailed description of the invention when taken in conjunction with the accompanying drawings, wherein like elements have like numerals throughout the drawings.

BRIEF DESCRIPTION OF THE DRAWINGS

The present invention is further described with reference to the accompanying drawings, which show a preferred embodiment of the present invention. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the present invention.

In the drawings, wherein like reference numerals indicate like parts.

DETAILED DESCRIPTION

Figure 1:
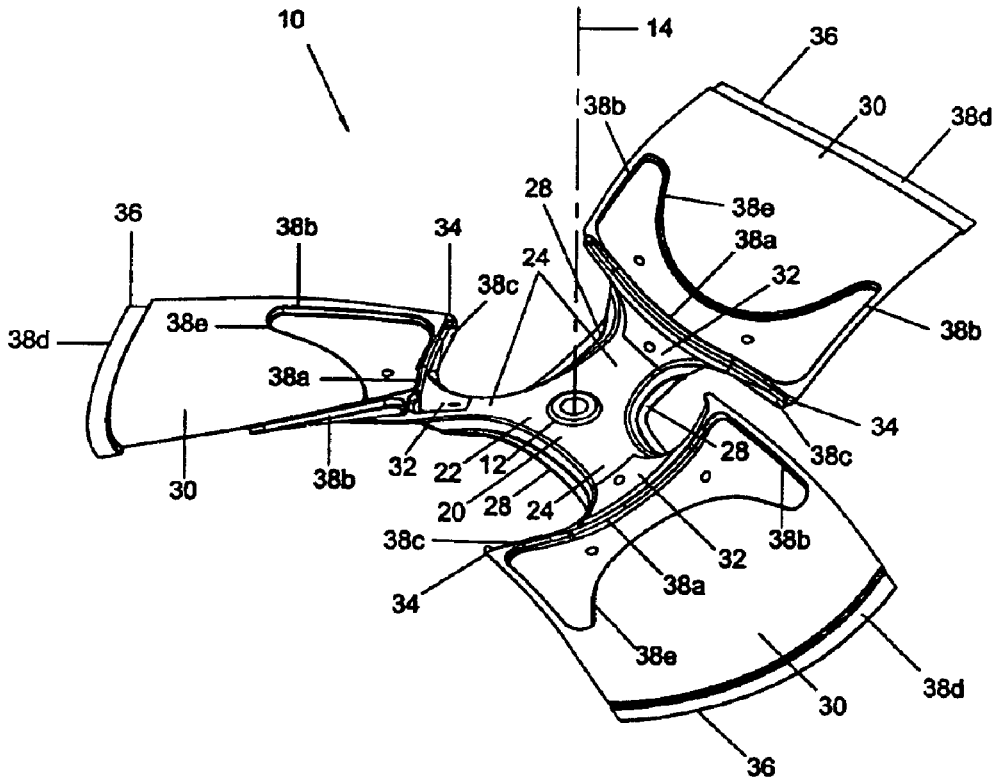
FIG. 1 is a front perspective view of a fan according to the present invention.

A fan according to the present invention is illustrated in FIGS. 1–5, and is designated with reference numeral 10. Although the illustrated fan 10 has a number of the inventive features of the present invention, it should be noted that other fans according to other embodiments of the present invention have less than all of the features illustrated in FIGS. 1–5 and described below. Accordingly, the fan 10 illustrated in FIGS. 1–5 and described below is presented by way of example only in order to illustrate the various features of the present invention. Other embodiments of the fan according to the present invention can therefore have fewer than all of the features illustrated in FIG. 1.

With reference to FIG. 1, the fan 10 (and more specifically, the spider 20 and fan blades 30 described below) is constructed of stamped sheet metal. Alternatively, one or more of the components of the fan 10 can be constructed of other types of materials such as plastic, fiberglass, and composite materials. Depending at least in part upon the material of the various fan components described herein, the fan components can be formed in any other manner, including without limitation by casting, molding, pressing, machining, and the like. As used herein and in the appended claims, the term "formed" (as well as the term "form" and its other derivatives) is understood to encompass any manner of making the fan component described, including those mentioned above.

The fan 10 is connectable to a drive shaft (not shown) via a central hub 12. The central hub 12 can take a number of different forms, such as a collar, bushing, circumferential boss or wall, an aperture through the fan, or any other element within which the drive shaft can be received. A central axis of rotation 14 of the fan 10 is defined by the external drive shaft. One or more fasteners can be employed to secure the central hub 12 (and the fan 10) to the drive shaft. By way of example only, a setscrew 16 can be received within a threaded aperture 18 in the central hub 12 and can be tightened against the drive shaft in a manner well known to those skilled in the art. In other embodiments, the central hub 12 can be provided with other fasteners (e.g., screws, bolts, pins, and the like) to secure the central hub 12 to the drive shaft and/or can be secured to the drive shaft 12 by a splined, keyed, or threaded connection, by an interference or press fit, by one or more tapered or quick-disconnect bushings or clamps, or in any other conventional manner.

In some embodiments, the central hub 12 is connected to a spider 20 further defining the center portion of the fan 10. The central hub can be connected to the spider 20 by a riveting process (such as by forming a portion of the central hub 12 over the edges of a central aperture in the spider), by welding, brazing, soldering, or gluing the central hub 12 to the spider 20, by a threaded, snap fit, interference fit, or press fit joint, by one or more conventional fasteners, or in any other conventional manner. The central hub 12 can even be integral with the spider 20.

The spider 20 can take any desired shape, and can have a plurality of arms to which fan blades 30 can be attached. In some embodiments, the spider has a central portion 22 and two or more arms 24 extending outwardly from the central portion 22. In order to provide a larger blade mounting area, the arms 24 can terminate in enlarged lobes 26. Alternatively, the terminal ends of the arms 24 can have any other shape desired, such as arms 24 that terminate bluntly or that have tapered ends, arms that have rounded distal ends, arms that have T- or Y-shaped distal ends, and the like.

Figure 2:
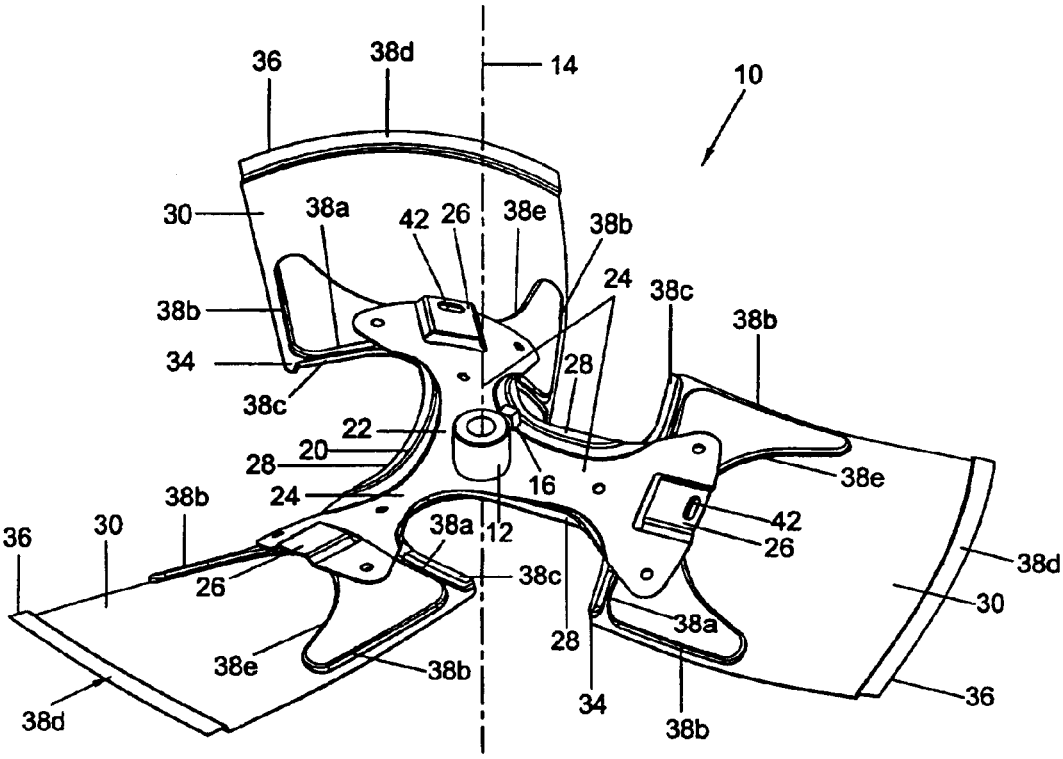
FIG. 2 is a rear perspective view of the fan illustrated in FIG. 1.
Figure 5:
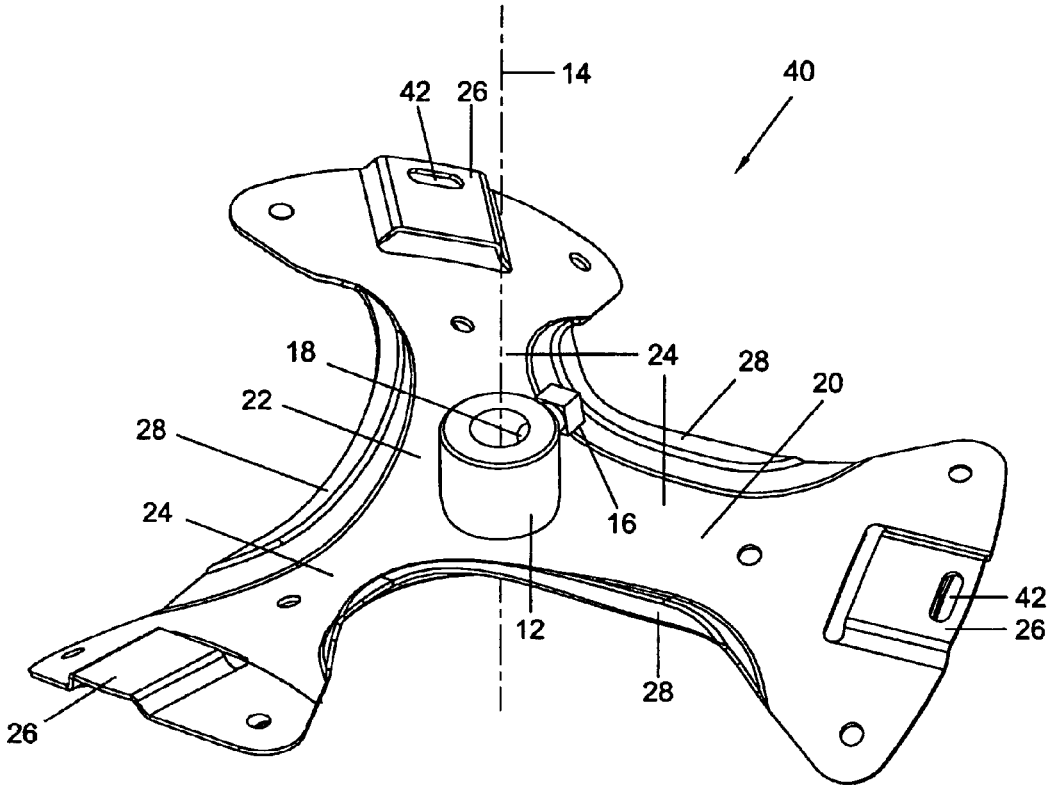
FIG. 5 is a rear perspective view of the spider assembly of the fan illustrated in FIGS. 1 and 2.

The central portion 22, arms 24, and lobes 26 of the spider 20 illustrated in FIGS. 1, 2, and 5 are integral with one another, such as by being formed from a single element (e.g., stamped, pressed, molded, cast, or machined from a blank of material). However, any of these components can be separate elements connected to the rest of the spider 20 in any manner, such as by riveting, welding, brazing, soldering, or gluing, by one or more conventional fasteners, by interengaging elements or features, and the like.

In some embodiments of the present invention, the spider 20 is embossed. As a result, the spider 20 is provided with improved strength and rigidity. For example, and with continued reference to FIGS. 1, 2, and 5, the spider 20 can have embossments 28 located between adjacent arms 24 of the spider 20. In some embodiments, the embossments can extend from one spider arm 24 to the next, and can extend along the edges of the spider 20. The embossments 28 can take the form of indented edges as shown in the figures, or can take any other form desired, such as dimples, ribs, recesses, protuberances, bosses, knurled portions of the spider 20, and the like. Embossments in such locations can provide superior structural properties to the spider 20. Alternate embodiments of the present invention can employ any type of random or patterned embossment desired.

The arms 24 of the spider 20 can be co-planar or substantially co-planar with the rest of the spider 20. However, in some embodiments the spider arms 24 have a twisted shape in order to provide fan blades 30 connected thereto with a pitch. In addition, the lobes 26 of the spider 20 can have cupped shapes to which the blades 10 are connected. If desired, cupped spider lobes 26 can be employed on spider arms 24 that are also twisted as described above. In some embodiments, good fan performance is obtained when the spider lobes 26 have a cup shape defined at least in part by a radius of curvature of less than 10 inches. In other embodiments, good performance is obtained when this radius of curvature falls is less than 6 inches. In still other embodiments, good performance is obtained within this radius of curvature falls between 3.5 inches and 4.0 inches. Although the spider 20 in the illustrated embodiment has lobes 26 with rounded cross-sectional shapes, it will be appreciated that the lobes 26 can instead have a V shaped cross-section, a cup shaped cross-section defined by a series of more planar surfaces, and the like.

The spider 20 can be made of any strong and substantially rigid material such as metal, plastic, fiberglass, and composites. In some embodiments, the spider 20 is made of steel, although other metals can instead be employed. With reference again to fans having about a 16–24 inch diameter, the spider 20 can be made of steel and can have a thickness of about 0.075 inches or less (14 gauge or thinner). However, in some embodiments the spider 20 for such fans has a thickness of about 0.059 inches or less (16 gauge or thinner). In still other embodiments, the spider 20 for such fans has a thickness of about 0.048 inches or less (18 gauge or thinner). The thicknesses just described are often determined by (and are) the thicknesses of commonly available sheet metal stock. Accordingly, it will be appreciated that these dimensions can be somewhat larger or smaller as a variable that is independent of stock material thicknesses (referring to the term "about" employed above). Specifically, and with reference again to fans having about a 16–24 inch diameter, the spider 20 can have a thickness of 0.080 inches or less. In some other embodiments, the spider 20 for such fans has a thickness of 0.065 inches or less. In still other embodiments, the spider 20 for such fans has a thickness of 0.055 inches or less.

The fan blades 30 can be rectangular in shape as shown in FIGS. 1–4*d*, and can each have leading and trailing edges defining the width of the fan blade 30. However, the fan blades 30 can have any other shape desired, including without limitation oval, round, trapezoidal, triangular, irregular, and other shapes. The fan blades 30 can be mounted to the spider arms 24 (and more specifically, to the spider lobes 26, if employed) at any location or locations desired, such as at one or more points, lines, or areas of interface between these elements. By way of example only, the fan blades 30 in the illustrated embodiment are mounted to the spider lobes 26 at three points of connection. One point is located radially inwardly with respect to two other points, and can be located at a radially-inward extension 32 of the fan blades 30 as shown in FIGS. 1–4*d*. All three points are located at the root 34 of the fan blades 30 (i.e., the radially innermost portions of the fan blades 30). In other embodiments, the point(s) of connection can be in other locations and other arrangements on the fan blades 30, such as a radially or circumferentially-extending line of connection, one or more points of connection located closer to the blade tip 36, and the like.

The fan blades 30 can be mounted to the spider arms 24 in any manner desired, such as by rivets as shown in FIGS. 1 and 2, by screws, bolts, pins, or other conventional fasteners, by welds, soldering, brazing, gluing, interengaging elements on the blades 30 and spider arms 24, and the like.

The fan blades 30 according to the present invention employ one or more design features (and in some cases, two or more design features concurrently) to achieve a level of performance equal to that of larger and heavier fans. As will now be discussed, these design features include using larger fan blade camber-to-chord ratios, using tapered camber-to-chord ratios, using twisted blade forms, and blade embossing.

As is well known to those skilled in the art, camber-to-chord ratios at least partially define the shape of a fan blade 30 along its length. With respect to any cross-sectional view of a fan blade 30 taken at a radial distance from the root 34 of the fan blade 30, camber is the depth of the fan blade 30 at the radial distance, while chord is the width of the fan blade 30 at the radial distance. Accordingly, a larger camber-to-chord ratio indicates a 'deeper' blade form (compared to a smaller camber-to-chord ratio).

Some embodiments of the present invention employ a blade camber-to-chord ratio that is deeper than conventional fan blades. For example, the camber-to-chord ratio in some embodiments does not fall below about 0.075 along at least a majority of the fan blade 30, and can even be at least about 0.075 along the entire blade length (i.e., along a longitudinal axis extending from the axis 14 of the fan 10 to the blade tip 36). This camber-to-chord ratio can be defined as the ratio of camber length to chord length of a blade cross section produced by passing a plane through the fan blade 30, in which the plane is oriented perpendicularly with respect to a straight line extending from the axis 14 of the fan 10 to the blade tip 36. In other embodiments, the camber-to-chord ratio of the fan blade 30 is at least about 0.09 at the blade root 34. In still other embodiments, the camber-to-chord ratio of the fan blade 30 is at least about 0.12 at the blade root. In addition, in some embodiments the camber-to-chord ratio of the fan blade 30 is at least about 0.16 at the blade tip 36. In other embodiments, the camber-to-chord ratio of the fan blade 30 is at least about 0.064 at the blade tip 36.

Although not required, fan performance can be enhanced in some embodiments of the present invention by a changing camber-to-chord ratio along the length of the fan blades 30. In some embodiments, the camber-to-chord ratio of the fan blades 30 decreases at least 35% from blade root 34 to blade tip 36. For example, the camber-to-chord ratios of some blades can decrease from about 0.12 at the blade root 34 to about 0.06 at the blade tip 36. In other embodiments, the camber-to-chord ratio of the fan blades 30 decreases at least 50% from blade root 34 to blade tip 36. For example, the camber-to-chord ratios of some blades can decrease from about 0.15 at the blade root 34 to about 0.06 at the blade tip 35 (i.e., a 60% decrease in camber-to-chord ratio). In still other embodiments, the camber-to-chord ratio of the fan blades 30 decreases at least 70% from blade root 34 to blade tip 36. For example, the camber-to-chord ratios of same blades can decrease from about 0.16 at the blade root 34 to about 0.045 at the blade tip 35 (i.e., a 72% decrease in camber-to-chord ratio).

Figures 3, 4A, 4B, 4C, 4D, 4E, 4F, 4G:
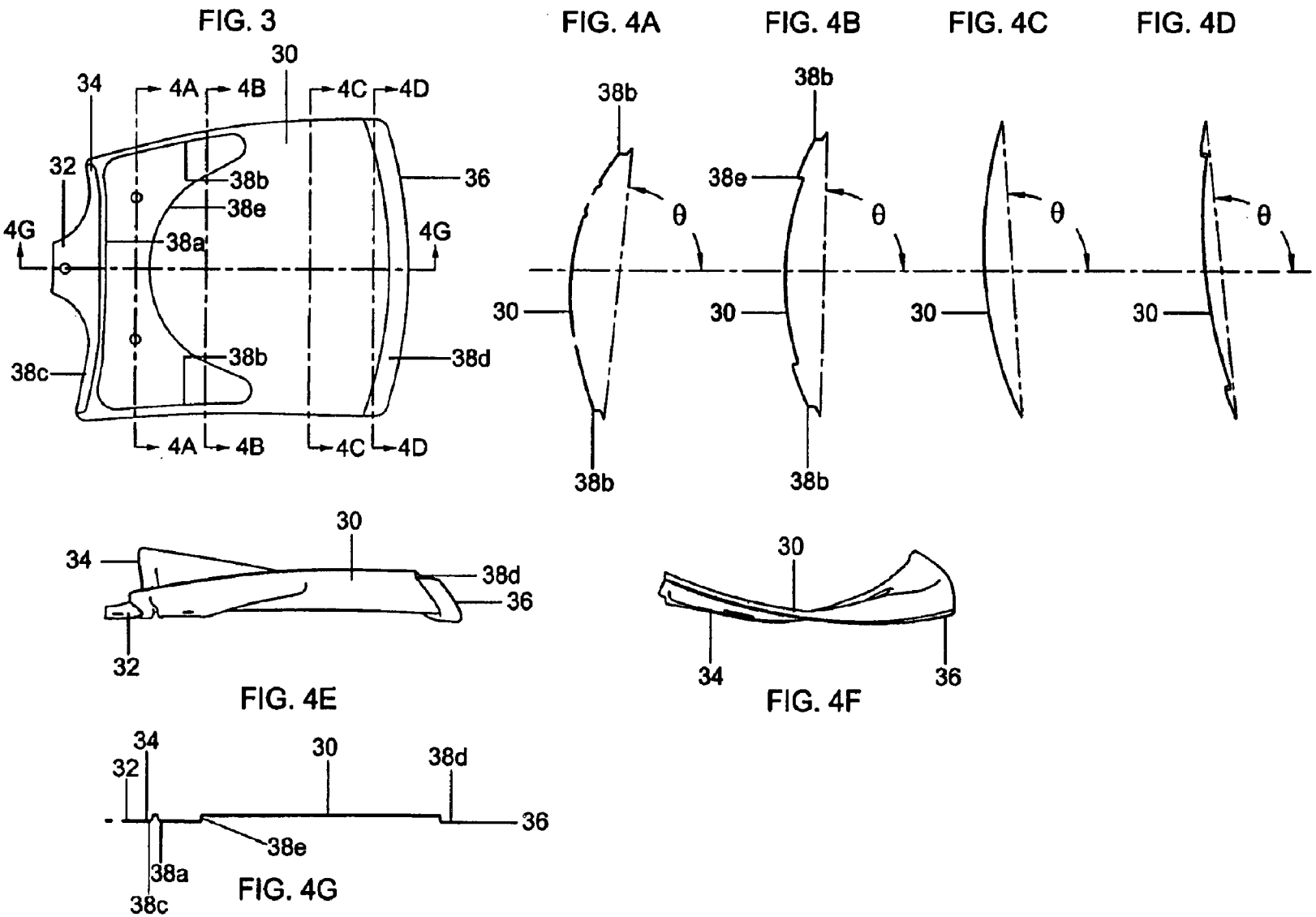
FIG. 3 is a rear view of a fan blade from the fan illustrated in FIGS. 1 and 2.
FIG. 4*a* is a cross-sectional view of the fan blade illustrated in FIG. 3, taken along lines 4*a*—4*a* in FIG. 3.
FIG. 4*b* is a cross-sectional view of the fan blade illustrated in FIG. 3, taken along lines 4*b*—4*b* in FIG. 3.
FIG. 4*c* is a cross-sectional view of the fan blade illustrated in FIG. 3, taken along lines 4*c*—4*c* in FIG. 3.
FIG. 4*d* is a cross-sectional view of the fan blade illustrated in FIG. 3, taken along lines 4*d*—4*d* in FIG. 3.
FIG. 4*e* is a side view of the fan blade illustrated in FIG. 3.
FIG. 4*f* is an end view of the fan blade illustrated in FIG. 3.
FIG. 4*g* is a cross-sectional view of the fan blade illustrated in FIG. 3, taken along lines 4*g*—4*g* in FIG. 3.

With reference now to FIG. 3, some embodiments of the present invention employ fan blades 30 that have a twisted shape along the length of the fan blades 30. FIGS. 4*a*–4*d* illustrate several cross-sectional views of a fan blade 30 in the fan 10 of FIGS. 1 and 2, taken at different radial locations along the fan blade 30. Although the camber-to-chord ratio can be constant along the blades 30, FIGS. 4*a*–4*d* illustrate how the camber-to-chord ratio of the fan blades 30 in the illustrated embodiment decrease with increasing radial distance from the axis of rotation 14 of the fan 10. The amount of twist of the fan blades 30 can be calculated by defining lines connecting opposite ends of the fan blade 30 near the fan blade root 34 and near the fan blade tip 36. The angular difference between these lines is defined as the amount of blade twist of the fan blade 30. In some embodiments, the blade twist is at least 6 degrees. In other embodiments, the blade twist is at least 7 degrees. In still other embodiments, the blade twist is between 8 and 11 degrees. The blade twist in the illustrated embodiment of FIGS. 1–4*d* is about 10 degrees.

If desired, the fan blades 30 can have embossments 38 to enhance the strength and/or rigidity of the fan blades 30. Although such embossments 38 can be located anywhere on the blades, in some embodiments the blade embossments 38 are located near or on the blade mounting portion of the fan blades 30 (i.e., at or near the spider lobes 26, if employed). An example of such embossments is illustrated in FIGS. 1–4*d*, which show blade embossments 38 in the form of indented shapes in the fan blades 30. In some embodiments, each blade 30 has an embossment running beside a radially-innermost edge of the blade 30. For example, an embossment 38*a* in the illustrated embodiment runs beside the innermost edge of each fan blade 30. Also, in some embodiments, each blade 30 has an embossment running beside either or both blade side edges. These side embossments can be separate from a radially-innermost embossment 38*a* (if such an embossment is employed), or can extend from such an embossment 38*a* to define a continuous or substantially continuous embossment extending along at least part of the root and side(s) of each blade 30. For example, embossments 38*b* in the illustrated embodiment run beside opposite sides of each fan blade 30, and are joined to the radially innermost embossment 38*a* described above.

In some cases, one or more embossments 38 can be located on the edge of the blade 30, while in other cases one or more embossments 38*a*, 38*b* can run beside the blade edges as described above. Either type of embossment (or even both, in some cases) can be employed along any edge of the fan blade 30. By way of example only, the innermost edge of each fan blade 30 illustrated in the figures has a first embossment 38*a* described above as well as a second embossment 38*c* on the same edge of the fan blade 30. As another example, a fourth type of embossment 38*d* is illustrated by way of example in the figures, and is located at an outermost edge of each fan blade 30. Any edge of the fan blade 30 can have either, both, or neither embossment 38 as desired.

When employed, root and/or side embossments 38*a*, 38*b* of each fan blade 30 can provide strength and rigidity to the fan blades 30. A continuous or substantially continuous embossment 38 at or running beside the innermost blade edge and either or both side blade edges can also provide improved blade strength and rigidity (e.g., the U-shaped embossment 38 defined by embossments 38*a* and 38*b* as illustrated in the figures). If desired, side embossments 38*b* can be joined across the fan blade 30 by an embossment 38*e* having any desired shape. In some embodiments, a U-shaped embossment 38*e* such as that shown in the figures provides good results.

Any portion of the fan blades 30 according to the present invention can be embossed. As indicated above, one or more embossments 38 can extend from the root of each blade 30 along at least 30 percent of the fan blade 30 on either or both sides of the fan blade 30. In other embodiments, one or more embossments 38 can extend from the root of each blade 30 along at least 50 percent of the fan blade 30 on either or both sides of the fan blade 30. In still other embodiments good fan blade properties are obtained when one or more embossments 38 extend from the root of each blade 30 along at least 70 percent of the fan blade 30 on either or both sides of the fan blade 30.

In addition to or as alternatives to the use of embossments 38 located along a root edge and/or sides of each fan blade 30, any number of embossments 38 in any pattern (or in no pattern) can be employed on the fan blades 30. These embossments 38 can take the form of ribs extending into or out of either face of each fan blade 30, can define plateaus or recesses in either face of each fan blade 30 as shown in the illustrated embodiment, or can be one or more dimples, ridges, corrugations, protuberances, beads, grooves, or other raised or recessed portions of the blade located on the fan blades 30 as described above to increase the strength and/or rigidity of the fan blades 30.

Another design aspect of the fan 10 according to the present invention relates to the width of the fan blades 30. In 16–24 inch diameter fans according to the present invention, one or more fan blade design features described above can be employed to enable the use of narrower fan blade widths. For example, the fan blades 30 in some embodiments of the present invention are less than 8 inches in width. In other embodiments, the fan blades 30 are less than 7 inches in width. In still other embodiments, the fan blades 30 are less than 6 inches in width. The fan blades 30 in the illustrated embodiment of FIGS. 1–4*d* are about 5.88 inches in width.

Similarly, one or more fan blade design features (including the use of narrower fan blades 30 as just discussed) can be employed to enable the use of thinner fan blade in 16–24 inch fans. For example, the fan blades 30 in some embodiments of the present invention are aluminum and have a thickness of less than 0.032 inches, or are steel and have a thickness of less than 0.025 inches. In other embodiments, the fan blades 30 are aluminum and have a thickness of about 0.020 inches, or are steel and have a thickness of about 0.015 inches. In some embodiments, the fan blades 30 are stamped from sheet material. However, the fan blades 30 can be formed in any other manner desired, including those mentioned above with respect to the spider 20.

As discussed above in the Background of the Invention, a common problem with many fans is the need to balance the fans after assembly. This problem is exacerbated in fans having a lighter construction, such as sheet metal fans and fans having one or more of the features described above which enable the fans to be constructed with less mass. The need to balance fans has been addressed in some embodiments of the present invention by the use of a pre-balanced spider assembly 40. In such embodiments, the pre-balanced spider assembly 40 includes the central hub 12, the setscrew 16 (or other fastener as described in greater detail above), and the spider 20. The pre-balanced spider assembly 40 according to the present invention employs a spider 20 that has a shape in which the mass of the spider 20 is distributed unequally or asymmetrically about the axis of rotation 14. This uneven or asymmetrical mass distribution can be achieved in a number of different manners.

By way of example only, the spider arms 24 (or the spider lobes 26, if employed) can be differently sized to result in such a mass distribution. As another example, the spider 20 can be formed (e.g., cast, stamped, pressed, molded, machined, and the like) with apertures or recesses in one or more spider arms 24, lobes 26, or the central portion 22 in order to unevenly or asymmetrically about the axis of rotation 14. Alternatively or in addition, the spider 20 can be formed with ribs, bumps, or other protuberances (in which additional material is located) on one or more spider arms 24, lobes 26, or in one or more areas on the central portion 22 for the same purpose. As yet another example, the central portion 22, spider arms 24, or lobes 26 can be asymmetrically shaped about the axis of rotation 14 or can otherwise be differently shaped to generate such a mass distribution.

In the illustrated embodiment of FIGS. 1–3 and 5, the uneven or asymmetrical mass distribution of the spider assembly 40 is produced by forming the spider 20 with apertures 42. These apertures 42 can take any shape and can be differently shaped if desired. Because the spider 20 is formed with these apertures 42, the spider assembly 40 can be assembled with the apertures 42 in a desired angular relationship with respect to the setscrew 16 (or other fastener) to counteract the mass imbalance resulting from the setscrew 16. Similarly, spider assemblies 40 employing spiders 20 that are shaped in other manners having the uneven or asymmetrical mass distribution as described above can also be assembled in the desired angular relationship with respect to the setscrew 16 to counteract the mass imbalance resulting from the setscrew 16.

With reference again to spider assembly 40 in FIGS. 1–3 and 5 by way of example only, two pre-balance apertures 42 are included in two of the three spider lobes 26 of the spider 20. These apertures 42 can be stamped from the spider 20 (e.g., when the spider 20 is stamped into shape), can be cast, pressed, or molded in the spider 20 (e.g., when the spider 20 is cast or molded), can be cut or otherwise machined in the spider 20 when the spider is formed, and the like. The amount of material missing from the apertures 42 is enough to offset the imbalance caused by the set screw 16. Since the magnitude of the imbalance forces between the two apertures 42 and the setscrew 16 are equal or substantially equal, their relative circumferential locations are selected to generate a balanced spider assembly 40. In the illustrated embodiment, this is accomplished by positioning the central hub 12 with respect to the spider 20 such that the set screw 16 is facing away from and is angularly aligned with the spider arm 24 having a spider lobe 26 without a pre-balance aperture 42.

As mentioned above, other spider shapes can be employed in the illustrated embodiment for the same purpose as just described. For example, a larger pre-balance aperture 42 located in the central portion 22 of the spider 20 can be employed to perform the same function. In such a case, the setscrew 16 could be oriented to face and be angularly aligned with the pre-balance aperture 42. As another example, combinations of more than two pre-balance apertures 42 in various radial and angular locations in the spider 20 can also or instead be employed, wherein the central hub 12 and the setscrew 16 are angularly positioned with respect to one another in order to offset the missing mass of the pre-balance apertures 42 with the additional mass of the setscrew 16.

In other embodiments of the present invention, the type of setscrew and/or the position of the setscrew 16 (or other fastener(s) employed as described above) generates an imbalance due to a lack of mass at the setscrew 16. For example, the setscrew 16 in the illustrated embodiment of FIGS. 1–3 and 5 can instead be recessed within the central hub 12, thereby resulting in an imbalance due to the lack of mass in that area of the spider 20. As another example, the setscrew 16 can be made of a lighter material than the central hub 12 and/or spider 20, can have one or more voids, or can otherwise be shaped to result in a reduction of mass in the area of the setscrew 16, thereby resulting in a similar imbalance. In such cases, the angular orientation of the spider 20 is again selected so that the mass imbalance generated by the setscrew 16 is offset by the mass imbalance of the spider 20 (whether by one or more apertures or recesses or by additional mass on one or more portions of the spider 20 as described above).

The various design features of the present invention described above can be selected to result in fans 10 that are lighter, more efficient, smaller in one or more respects, more effective at moving air or other fluid, less expensive to manufacture, and/or stronger than conventional fans. By way of example only, the use of spider arms 24 that have a twisted shape, coupled one or more of the other fan design features described above (e.g., spider lobes 26 with a cupped shape as described above, a spider 20 having the thinner dimensions as described above, fan blades 30 having the above-described camber-to-chord ratios, fan blades 30 having the tapering camber-to-chord ratios described above, fan blades 30 having the twisted shapes as described above, fan blades 30 having the thinner and/or narrower dimensions described above, fan blades 30 having embossments 38 as described above, and spiders 20 having one or more embossments 28 as also described above) results in a fan 10 that provides advantages over conventional fans.

With reference (for example) to 16–24 inch fans, the user of a spider 20 having the thinner dimensions described above, coupled with one or more of the other fan design features also described above (e.g., spider lobes 26 with a cupped shape as described above, fan blades 30 having the above-described camber-to-chord ratios, fan blades 30 having the tapering camber-to-chord ratios described above, fan blades 30 having the twisted shapes as described above, fan blades 30 having the thinner and/or narrower dimensions described above, fan blades 30 having embossments 38 as described above, and spiders 20 having one or more embossments 28 as also described above) results in a fan 10 that provides advantages over conventional fans.

In other embodiments (including 16–24 inch fans), the user of a spider 20 having the cupped spider lobes 26 as described above, coupled with one or more of the other fan design features also described above (e.g., fan blades 30 having the above-described camber-to-chord ratios, fan blades 30 having the tapering camber-to-chord ratios described above, fan blades 30 having the twisted shapes as described above, fan blades 30 having the thinner and/or narrower dimensions described above, fan blades 30 having embossments 38 as described above, and spiders 20 having one or more embossments 28 as also described above) results in a fan 10 that provides advantages over conventional fans.

In still other embodiments, the use of fan blades 30 having the deeper camber-to-chord ratios described above, coupled with one of more of the other fan design features also described above (e.g., fan blades 30 having the tapering camber-to-chord ratios described above, fan blades 30 having the twisted shapes as described above, fan blades 30 having the thinner and/or narrower dimensions described above, fan blades 30 having embossments 38 as described above, and spiders 20 having one or more embossments 28 as also described above) results in a fan 10 that provides advantages over conventional fans.

As another example, the use of fan blades 30 having the tapering camber-to-chord ratios described above, coupled with one or more of the other fan design features also described above (e.g., fan blades 30 having the twisted shapes as described above, fan blades 30 having the thinner and/or narrower dimensions described above, fan blades 30 having embossments 38 as described above, and spiders 20 having one or more embossments 28 as also described above) results in a fan 10 that provides advantages over conventional fans.

In other embodiments, the use of fan blades 30 having the twisted shapes described above, coupled with one or more of the other fan design features also described above (e.g., fan blades 30 having the thinner and/or narrower dimensions described above, fan blades 30 having embossments 38 as described above, and spiders 20 having one or more embossments 28 as also described above) results in a fan 10 that provides advantages over conventional fans.

With reference (for example) to 16–24 inch fans, the use of fan blades 30 having the thinner and dimensions described above, coupled with one or more of the other fan design features also described above (e.g., fan blades 30 having the narrower dimensions described above, fan blades 30 having embossments 38 as described above, and spiders 20 having one or more embossments 28 as also described above) results in a fan 10 that provides advantages over conventional fans.

With reference also (for example) to 16–24 inch fans, the use of fan blades having the narrower dimensions described above, coupled with one or more of the other fan design features also described above (e.g., fan blades 30 having embossments 38 as described above, and spiders 20 having one or more embossments 28 as also described above) results in a fan 10 that provides advantages over conventional fans.

As another example, the use of fan blades having embossments 38 as described above, coupled with a spider having the embossments also described above, results in a fan 10 that provides advantages over conventional fans.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the appended claims.

What is claimed is:

1. A spider for attachment to a central hub having a fastener and for use in fans no smaller than about 16 inches and no larger than about 24 inches in diameter, the fastener producing an amount of mass imbalance of the hub about an axis of rotation of the hub, the spider comprising:

an axis of rotation of the spider;

a central portion comprised of steel not greater than 0.080 inches in nominal thickness, the central portion adapted to be coupled to the central hub; and a plurality of radially projecting arms comprised of steel not greater than 0.080 inches in nominal thickness, each spider arm extending radially outward from the central portion of the spider;

the spider having a shape that is asymmetrical about the axis of rotation of the spider, the shape of the spider producing an amount of mass imbalance about the axis of rotation of the spider, the spider adapted to be coupled to the hub at an angular orientation with respect to the hub in which the mass imbalance of the hub is substantially offset by the mass imbalance of the spider, whereby attachment of the spider having the asymmetrical shape to the hub at the angular orientation creates a substantially balanced spider assembly.

2. The spider as claimed in claim 1, wherein spider comprises a stamped sheet of steel.

3. The spider as claimed in claim 1, wherein:

the fastener is a threaded fastener; and the imbalance of the hub is generated at least in part by an aperture in the hub into which the fastener is received.

4. The spider as claimed in claim 1, wherein:

the fastener is a threaded fastener; and the imbalance of the hub is generated at least in part by a position of the threaded fastener with respect to the hub.

5. The spider as claimed in claim 1, wherein the spider has at least one aperture therein at least partially defining the mass imbalance of the spider about the axis of rotation of the spider.

6. The spider as claimed in claim 1, wherein each spider arm has a lobe adapted for attachment to a fan blade, the cupped shape of each lobe defined at least in part by a radius of curvature no greater than 10 inches.

7. The spider as claimed in claim 6, wherein at least part of the cupped shape of each lobe is defined by a radius of curvature no greater than 6 inches.

8. The spider as claimed in claim 6, wherein at least part of the cupped shape of each lobe is defined by a radius of curvature between 3.5 and 4 inches.

9. The spider as claimed in claim 1, wherein the spider has a nominal thickness of no greater than about 0.080 inches.

10. The spider as claimed in claim 1, wherein the spider has a nominal thickness of no greater than about 0.065 inches.

11. The spider as claimed in claim 1, wherein the spider has a nominal thickness of no greater than about 0.055 inches.

12. The spider as claimed in claim 1, wherein each spider arm has a length in a radial direction of the spider, each spider arm having a twisted shape along the length of the spider arm.

13. The spider as claimed in claim 1, further comprising at least one embossment.

14. The spider as claimed in claim 13, wherein the at least one embossment is located at a peripheral edge of the spider.

15. A method of manufacturing a fan assembly, comprising:

providing an amount of mass imbalance created in a hub of the fan assembly by at least one hub fastener;

forming a body of a spider from a sheet of metal, the spider having an axis of rotation;

forming a plurality of locations on the spider to which fan blades can be coupled;

creating an asymmetrical mass distribution in the spider about the axis of rotation, the asymmetrical mass distribution of the spider selected to offset the mass imbalance of the hub in a selected angular relationship of the spider and hub about the axis of rotation; and coupling the spider to the hub in the selected angular relationship after creating the asymmetrical mass distribution in the spider.

16. The method as claimed in claim 15, wherein the mass imbalance of the hub is created at least in part by an aperture in the hub into which the hub fastener is received.

17. The method as claimed in claim 15, wherein the mass imbalance of the hub is created at least in part by a position of the hub fastener relative to the hub.

18. The method as claimed in claim 15, wherein forming the body of the spider includes stamping the body of the spider from the sheet of metal.

19. The method as claimed in claim 15, wherein forming the body of the spider includes stamping the body of the spider from a sheet of metal having a nominal thickness no greater than about 0.080 inches.

20. The method as claimed in claim 15, wherein forming the body of the spider includes stamping the body of the spider from a sheet of metal having a nominal thickness no greater than about 0.065 inches.

21. The method as claimed in claim 15, wherein forming the body of the spider includes stamping the body of the spider from a sheet of metal having a nominal thickness no greater than about 0.055 inches.

22. The method as claimed in claim 15, wherein forming the plurality of locations to which fan blades can be coupled includes forming a plurality of cupped lobes each defined at least in part by a radius of curvature no greater than 10 inches.

23. The method as claimed in claim 22, wherein each cupped lobe is defined at least in part by a radius of curvature no greater than 6 inches.

24. The method as claimed in claim 22, wherein each cupped lobe is defined at least in part by a radius of curvature between 3.5 and 5 inches.

25. The method as claimed in claim 15, wherein forming the plurality of locations to which fan blades can be coupled includes forming a plurality of spider arms extending away from the axis of rotation, each spider arm having a twisted shape along a length of the spider arm.

26. The method as claimed in claim 15, further comprising forming at least one embossment on the spider.

27. A method of manufacturing a spider assembly, comprising:

forming a spider body from a sheet of metal, the spider having an axis of rotation;

forming an imbalance in the spider body about the axis of rotation, the imbalance having an amount selected to offset an anticipated imbalance of the spider assembly generated by a hub of the spider assembly;

coupling the hub to the spider body after forming the imbalance in the spider body, the hub having an imbalance and being coupled to the spider assembly in a relative orientation about the axis of rotation, the imbalance of the spider body and the imbalance of the hub substantially offsetting one another in the relative orientation of the hub and spider body about the axis of rotation to produce a balanced spider assembly.

28. The method as claimed in claim 27, wherein forming the spider body includes stamping the spider body from the sheet of metal.

29. The method as claimed in claim 27, wherein forming the spider body includes stamping the spider body from a sheet of metal having a nominal thickness no greater than about 0.080 inches.

30. The method as claimed in claim 27, wherein forming the spider body includes stamping the spider body from a sheet of metal having a nominal thickness no greater than about 0.065 inches.

31. The method as claimed in claim 27, wherein forming the spider body includes stamping the spider body from a sheet of metal having a nominal thickness no greater than about 0.055 inches.

32. The method as claimed in claim 27, further comprising forming a plurality of cupped locations on the spider body to which fan blades can be coupled, each cupped location defined at least in part by a radius of curvature no greater than 10 inches.

33. The method as claimed in claim 32, wherein each cupped location is defined at least in part by a radius of curvature no greater than 6 inches.

34. The method as claimed in claim 32, wherein each cupped location is defined at least in part by a radius of curvature between 3.5 and 5 inches.

35. The method as claimed in claim 27, further comprising forming a plurality of spider arms to which fan blades can be coupled, each spider arm extending away from the axis of rotation and having a twisted shape along a length of the spider arm.

36. The method as claimed in claim 27, further comprising forming at least one embossment on the spider body.

37. A fan, comprising:

an axis about which the fan is rotatable;

a plurality of fan blades, each fan blade having a tip and a root;

a spider having a plurality of radially extending arms to which the plurality of fan blades are coupled, the tips of the plurality of fan blades defining a fan diameter greater than about 16 inches and less than about 24 inches;

each spider arm having a cupped portion to which one of the plurality of fan blades is coupled, the cupped portions of the spider arms each having a curved cross-sectional shape defined at least partially by a radius of curvature that is less than 10 inches;

each fan blade having a length and a curved cross-sectional shape defining a camber-to-chord ratio at different radial distances from the axis; and wherein the camber-to-chord ratio at the tip of each fan blade is at least 0.064.

38. A fan, comprising:

an axis about which the fan is rotatable;

a plurality of fan blades, each fan blade having a tip and a root;

a spider having a plurality of radially extending arms to which the plurality of fan blades are coupled, the tips of the plurality of fan blades defining a fan diameter greater than about 16 inches and less than about 24 inches;

each spider arm having a cupped portion to which one of the plurality of fan blades is coupled, the cupped portions of the spider arms each having a curved cross-sectional shape defined at least partially by a radius of curvature that is less than 10 inches;

each fan blade having a length and a curved cross-sectional shape defining a camber-to-chord ratio at different radial distances from the axis; and wherein the camber-to-chord ratio decreases from the root of each fan blade to the tip of each fan blade.

39. A fan, comprising:

an axis about which the fan is rotatable;

a plurality of fan blades, each fan blade having a tip and a root;

a spider having a plurality of radially extending arms to which the plurality of fan blades are coupled, the tips of the plurality of fan blades defining a fan diameter greater than about 16 inches and less than about 24 inches;

each spider arm having a cupped portion to which one of the plurality of fan blades is coupled, the cupped portions of the spider arms each having a curved cross-sectional shape defined at least partially by a radius of curvature that is less than 10 inches;

each fan blade has a length and a curved cross-sectional shape defining a camber-to-chord ratio at different radial distances from the axis;

the camber-to-chord ratio decreases from the root of each fan blade to the tip of each fan blade; and wherein the camber-to-chord ratio of each fan blade decreases at least 20% along the length of the fan blade.

40. A fan, comprising:

an axis about which the fan is rotatable;

a plurality of fan blades, each fan blade having a tip and a root; and a spider having a plurality of radially extending arms to which the plurality of fan blades are coupled, the tips of the plurality of fan blades defining a fan diameter greater than about 16 inches and less than about 24 inches;

each spider arm having a cupped portion to which one of the plurality of fan blades is coupled, the cupped portions of the spider arms each having a curved cross-sectional shape defined at least partially by a radius of curvature that is less than 10 inches;

each fan blade has a length and a curved cross-sectional shape defining a camber-to-chord ratio at different radial distances from the axis;

the camber-to-chord ratio decreases from the root of each fan blade to the tip of each fan blade; and wherein the camber-to-chord ratio of each fan blade decreases at least 35% along the length of the fan blade.

41. A fan, comprising:

an axis about which the fan is rotatable;

a plurality of fan blades, each fan blade having a tip and a root; and a spider having a plurality of radially extending arms to which the plurality of fan blades are coupled, the tips of the plurality of fan blades defining a fan diameter greater than about 16 inches and less than about 24 inches;

each spider arm having a cupped portion to which one of the plurality of fan blades is coupled, the cupped portions of the spider arms each having a curved cross-sectional share defined at least partially by a radius of curvature that is less than 10 inches;

each fan blade has a length and a curved cross-sectional share defining a camber-to-chord ratio at different radial distances from the axis;

the camber-to-chord ratio decreases from the root of each fan blade to the tip of each fan blade; and wherein the camber-to-chord ratio of each fan blade decreases at least 50% along the length of the fan blade.

42. A fan, comprising:

an axis of rotation;

a hub;

a plurality of fan blades coupled to the hub and rotatable about the axis of rotation, each fan blade having:

a length;

a longitudinal axis extending from the axis of rotation and along the length of the blade;

a leading edge;

a trailing edge;

a width between the leading and trailing edges;

a blade root;

a blade tip located further away from the axis of rotation than the blade root;

the blade having a cross-sectional shape defined by a plane passing through the blade and oriented perpendicularly with respect to the longitudinal axis of the blade, the cross-sectional shape of the blade having a camber-to-chord ratio of at least 0.075 along at least a majority of the length of the blade; and wherein the camber-to-chord ratio of each fan blade decreases from the root of each fan blade to the tip of each fan blade.

43. A fan, comprising:

an axis of rotation;

a hub;

a plurality of fan blades coupled to the hub and rotatable about the axis of rotation, each fan blade having:

a length;

a longitudinal axis extending from the axis of rotation and along the length of the blade;

a leading edge;

a trailing edge;

a width between the leading and trailing edges;

a blade root;

a blade tip located further away from the axis of rotation than the blade root;

the blade having a cross-sectional shape defined by a plane passing through the blade and oriented perpendicularly with respect to the longitudinal axis of the blade, the cross-sectional shape of the blade having a camber-to-chord ratio of at least 0.075 along at least a majority of the length of the blade; and wherein the camber-to-chord ratio of each fan blade decreases at least 20% along the length of the fan blade.

44. A fan, comprising:

an axis of rotation;

a hub;

a plurality of fan blades coupled to the hub and rotatable about the axis of rotation, each fan blade having:

a length;

a longitudinal axis extending from the axis of rotation and along the length of the blade;

a leading edge;

a trailing edge;

a width between the leading and trailing edges;

a blade root;

a blade tip located further away from the axis of rotation than the blade root;

the blade having a cross-sectional shape defined by a plane passing through the blade and oriented perpendicularly with respect to the longitudinal axis of the blade, the cross-sectional shape of the blade having a camber-to-chord ratio of at least 0.075 along at least a majority of the length of the blade; and wherein the camber-to-chord ratio of each fan blade decreases at least 35% along the length of the fan blade.

45. A fan, comprising:

an axis of rotation;

a hub;

a plurality of fan blades coupled to the hub and rotatable about the axis of rotation, each fan blade having:

a length;

a longitudinal axis extending from the axis of rotation and along the length of the blade;

a leading edge;

a trailing edge;

a width between the leading and trailing edges;

a blade root;

a blade tip located further away from the axis of rotation than the blade root;

the blade having a cross-sectional shape defined by a plane passing through the blade and oriented perpendicularly with respect to the longitudinal axis of the blade, the cross-sectional shape of the blade having a camber-to-chord ratio of at least 0.075 along at least a majority of the length of the blade; and wherein the camber-to-chord ratio of each fan blade decreases at least 50% along the length of the fan blade.

* * * * *